US007311141B2

(12) United States Patent
Tulloch et al.

(10) Patent No.: US 7,311,141 B2
(45) Date of Patent: Dec. 25, 2007

(54) CASING SCRAPER

(75) Inventors: Rory Tulloch, Aberdeen (GB); Bruce McGarian, Aberdeen (GB)

(73) Assignee: Smith International, Inc., Houston, TX (US)

( * ) Notice: Subject to any disclaimer, the term of this patent is extended or adjusted under 35 U.S.C. 154(b) by 139 days.

(21) Appl. No.: 11/076,045

(22) Filed: Mar. 10, 2005

(65) Prior Publication Data

US 2005/0205252 A1 Sep. 22, 2005

(30) Foreign Application Priority Data

Mar. 11, 2004 (GB) ..... 0405524.0
Oct. 27, 2004 (GB) ..... 0423855.6

(51) Int. Cl.
*E21B 37/02* (2006.01)

(52) U.S. Cl. ..... 166/173; 166/170; 15/104.16

(58) Field of Classification Search ..... 166/170, 166/173, 174; 15/104.16
See application file for complete search history.

(56) References Cited

U.S. PATENT DOCUMENTS 2,811,210 A * 10/1957 Guillot ..... 166/173
4,798,246 A * 1/1989 Best ..... 166/311
5,819,353 A * 10/1998 Armell et al. ..... 15/104.2
6,152,220 A * 11/2000 Carmichael et al. ..... 166/173
6,408,945 B1 * 6/2002 Telfer ..... 166/311
6,851,472 B2 * 2/2005 Hern et al. ..... 166/173

* cited by examiner

*Primary Examiner*—David Bagnell
*Assistant Examiner*—Giovanna M Collins
(74) *Attorney, Agent, or Firm*—Dykema Gossett PLLC

(57) ABSTRACT

A casing scraper comprises a plurality of blade modules mounted on a mandrel. The blade modules are identical to each other and have castellated ends which are engaged with the couplers to prevent relative rotation between the modules. By manipulation of a thread protector the modules can be operated in a configuration in which they are free to rotate relative to the mandrel or in a configuration in which they are rotationally fast with the mandrel. Each module comprises a housing in which a plurality of scraper blades are mounted. The scraper blades include shoulders which prevent the blades passing completely through mounting windows provided in the housing and are biased radially outwardly relative to the housing by compression springs.

20 Claims, 4 Drawing Sheets

CASING SCRAPER

BACKGROUND OF INVENTION a. Field of Invention

This invention relates to a casing scraper, that is a tool for use in a wellbore to scrape debris from the interior of the wellbore casing.

b. Description of Related Art

In wellbore clean-up and mud displacement operations it is well known to use a casing scraper to remove debris from the interior surface of the casing. Casing scrapers may be non-rotating (that is there is substantially no rotation of the casing scraper relative to the casing) or may be rotating (in which case the scraper is forcibly rotated relative to the casing to increase the scraping action). In many clean-up operations, particularly on newly cased wells, non-rotating scrapers are preferred because of their relatively less aggressive scraping action. However, in other clean-up operations a more aggressive action produced by rotating the scraper at, for example 40-120 rpm is preferred.

Scrapers are available from a number of commercial sources, and the present invention provides an improved design in this type of tool.

SUMMARY OF INVENTION

According to a first aspect of the present invention a casing scraper comprises at least one blade module, the blade module comprising a tubular housing having a plurality of windows formed therein; a respective scraper block mounted in each window, each scraper block having retaining projections which prevent the scraper block moving completely through its associated window, and spring means acting on the scraper blocks to bias them radially outwardly of the housing.

The combination of scraper blocks with retaining projections which prevent them moving completely through the windows and spring means which bias the scraper blocks radially outwardly means that, within limits determined by the design, the scraper blocks can float radially as they encounter variations in the inside diameter of the casing being scraped. Contact of the scraper blocks with the casing will be under the influence of the springs, and if an area of reduced casing ID is encountered the springs will be compressed to allow the scraper blocks to move radially inwardly. Each block module is accordingly able to accommodate variations in casing ID.

In the preferred embodiment of the present invention a plurality of modules are provided along the length of the tool. Preferably, the modules are identical and are interconnected to prevent relative rotation therebetween.

Preferably, the or each module is rotatably mounted on a mandrel to enable the scraper to function as a non-rotating scraper. In the preferred embodiment of the invention means are additionally provided for rotationally locking the or each module to the associated mandrel so that the tool may function as a rotating scraper. Preferably, the change from non-rotating to rotating operation may be effected on site by manipulation of a locking member provided on the tool assembly.

Preferably, the spring means are coil springs and in the preferred embodiment of the invention are die springs. Preferably, the springs react between the scraper blocks and a base plate which is itself secured to the housing by screws which are inserted from the interior of the tubular housing, that is the heads of the screws are located facing radially inwardly. Preferably, backing off of the screws to an extent which will disengage the screws from the housing is prevented by the presence of the mandrel. Accordingly, when the various components have been assembled there is no possibility of the screws backing off to such an extent that the connection between the spring base plate and the housing is lost.

BRIEF DESCRIPTION OF THE DRAWINGS

The invention will be better understood from the following description of a preferred embodiment thereof given by way of example only, reference being had to the accompanying drawings wherein.

DETAILED DESCRIPTION OF THE PREFERRED EMBODIMENTS

Figure 1:
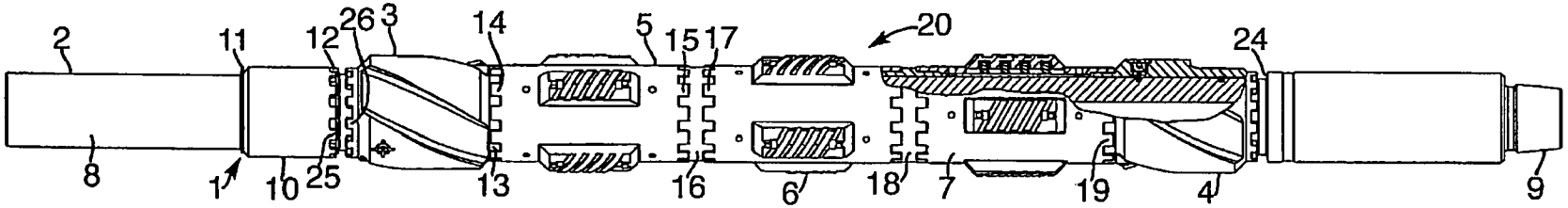
FIG. 1 is a side view, partly broken away, illustrating a first embodiment of the present invention.

Referring firstly to FIG. 1 there is illustrated a casing scraper 1 comprising a mandrel 2, stabilisers 3, 4 and three blade modules 5, 6, 7. The stabiliser 3 is substantially identical to the stabiliser 4 and the blade modules 5, 6, 7 are substantially identical to each other.

The mandrel 2 has a box connector 8 at the upper end thereof and a pin connector 9 at the lower end thereof to enable the scraper 1 to be connected with other tools to form a bottom hole assembly. The mandrel includes a threaded region which is covered by a thread protector 10. The thread protector 10 is a steel sleeve which is internally threaded to mate with the threads on the mandrel. When the tool is operating in a non-rotating mode the thread protector 10 is maintained in the position illustrated in FIG. 1 by circlips 11, 12.

Each of the components 3, 4, 5, 6, 7 is connected to its adjacent component or components by means which prevent relative rotation therebetween. In particular, the lower end of the upper stabiliser 3 is formed with castellations 13 which mate with complementary castellations 14 provided on the upper end of the blade module 5, the lower end of the blade module 5 is provided with castellations 15 which mate with complementary castellations provided on the upper end of a coupler 16, and castellations on the lower end of the coupler 16 mate with castellations 17 on the upper end of the blade module 6. The blade modules 6 and 7 are likewise interconnected by a coupler 18 whilst the lower end of the blade module 7 has castellations 19 which mate with complementary castellations on the upper end of the stabiliser 4. Thus, the two stabilisers and the three blade modules form an interconnected assembly 20 all the components of which are rotationally interlocked with each other.

Figure 2:
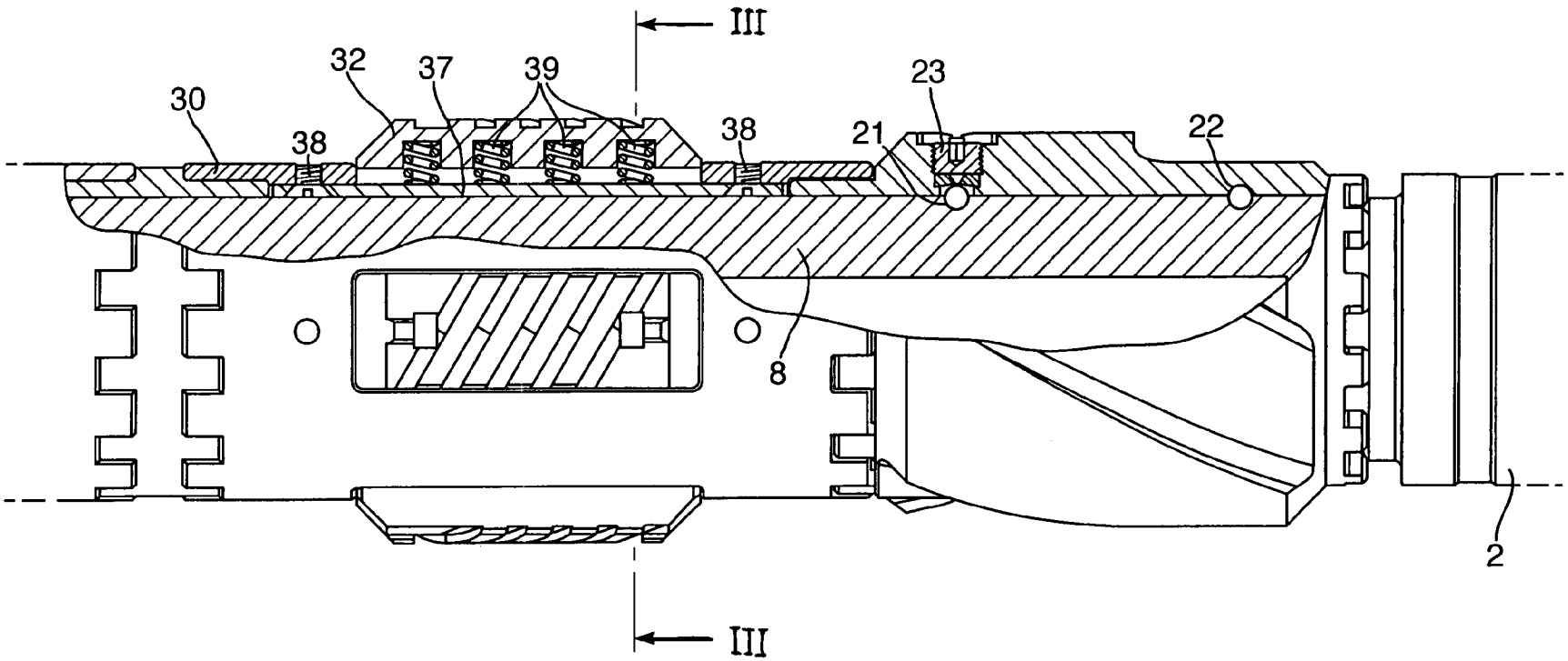
FIG. 2 is an enlarged view of the broken away portion of FIG. 1.

Referring now to FIG. 2, the entire assembly 20 is mounted on the mandrel 2 by means of two ball bearings 21, 22 between the stabiliser 4 and the mandrel and two ball bearings (not illustrated, but substantially identical to the ball bearings 21, 22) between the stabiliser 3 and the mandrel 2. Each of the ball bearings comprises a ball race formed in the outer surface of the mandrel 2, a ball race formed on the inner surface of the stabiliser 3, 4 and a plurality of balls located between the races. A plug 23 is provided for each ball bearing to enable the balls of the bearing to be inserted from the exterior of the associated scraper 1. Means are provided for preventing accidental release of the plugs 23. Under each of the plugs 23 is a ball race insert which has a square cross section in mid-length to stop the internal radius moving out of position over the ball grooves so that its internal radius matches the half circular groove of the ball race machine into the bore of the stabiliser body. The ball bearings serve to mount the assembly 20 for rotation relative to the mandrel and axially locate the assembly on the mandrel.

It will be noted that the lower end of the mandrel includes a shoulder 24 which will retain all the components of the assembly 20 on the mandrel in the event of failure of the ball bearings.

If the tool 1 is required to operate in a rotating mode, that is with the assembly 20 rotationally fast with the mandrel, this can be effected on site by removing the circlip 12 and rotating the thread protector 10 relative to the mandrel 2 to engage castellations 25 provided on the lower end of the thread protector 10 with complementary castellations 26 provided on the upper end of the stabiliser 3. When the thread protector 10 has been torqued down to the required value it is locked in place by suitable means, for example a circlip located in a groove provided for the purpose in the mandrel. With the castellations 25, 26 inter-engaged with each other and the thread protector 10 locked in position the entire assembly 20 will rotate with the mandrel and accordingly the tool can operate at a rotating scraper.

Figure 4:
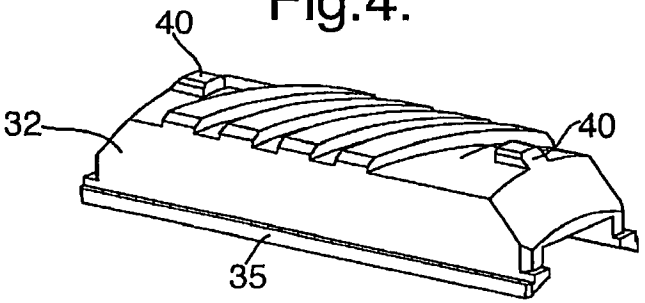
FIG. 4 is an isometric view of a scraper block.
Figure 3:
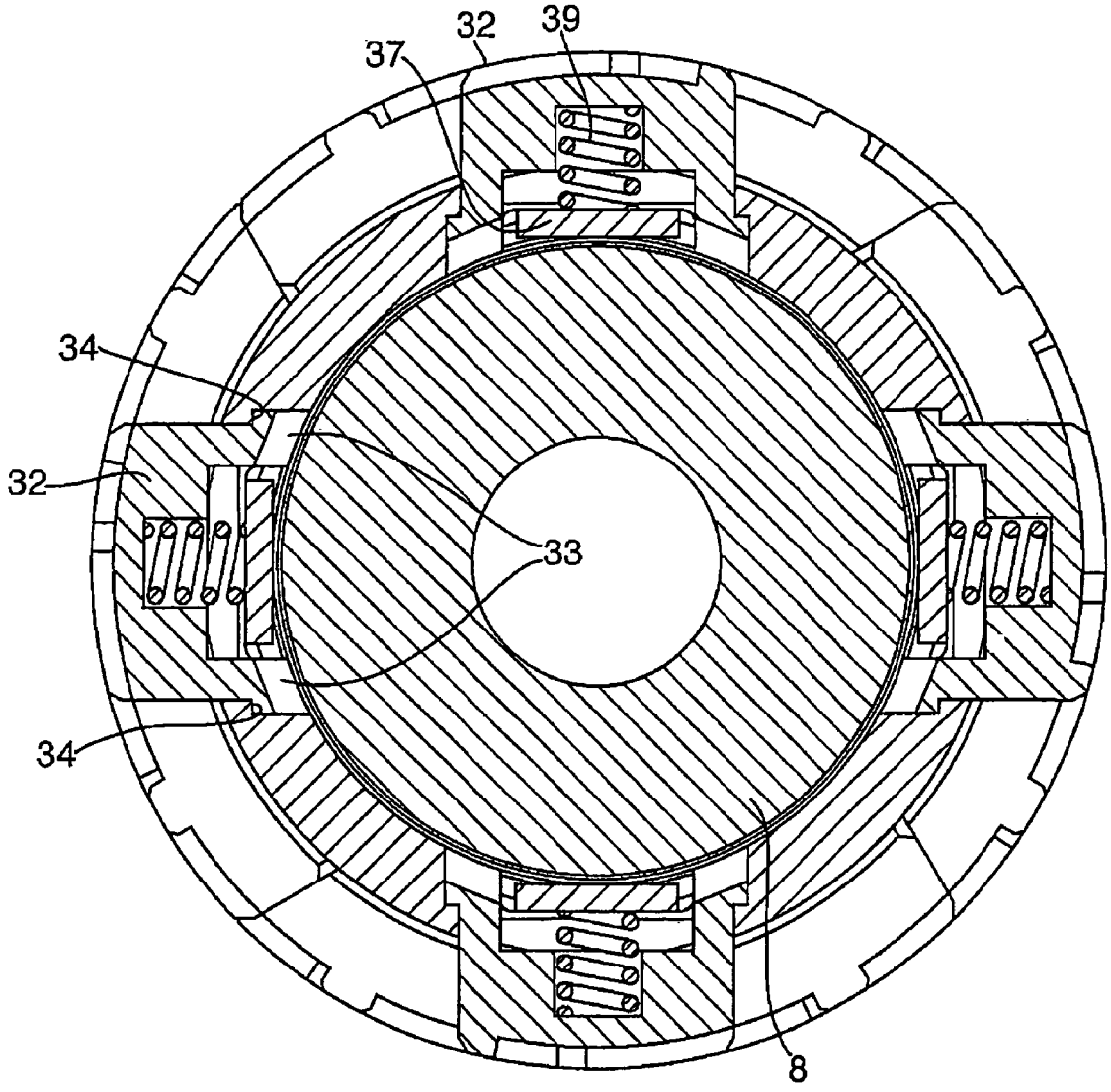
FIG. 3 is an enlarged cross section on the line III-III of FIG. 2.
Figure 5:
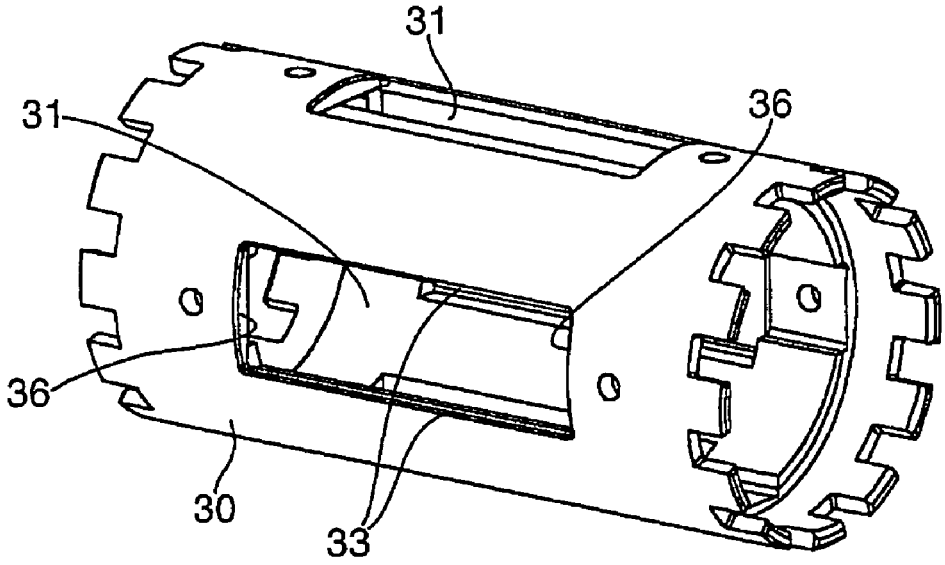
FIG. 5 is an isometric view of a module housing.
Figure 6:
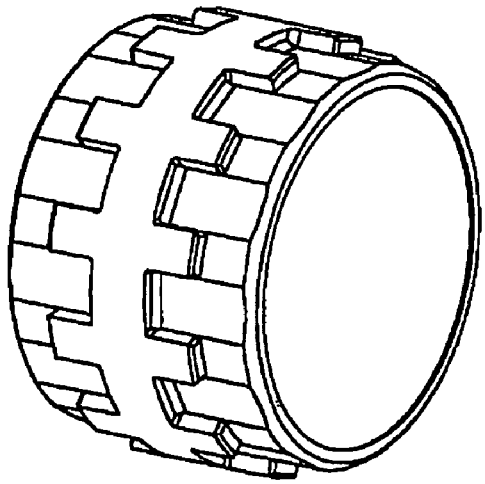
FIG. 6 is an isometric view of a module coupler.

Details of the mounting arrangements for the scraper blades are illustrated in FIGS. 2 and 3 and respective isometric views of a blade and a tubular housing are shown in FIGS. 4 and 5. The tubular housing 30 illustrated in FIG. 5 has four windows 31 each of which receives a respective scraper blade 32. As best seen in FIG. 3, the longitudinally extending walls 33 of each window are each formed with a step 34 which co-operate with respective projections 35 provided along the longitudinal edges of the scraper blocks 32 to prevent the scraper blocks passing completely through the windows. Accordingly, the scraper blocks 32 must be assembled into the windows 31 from the interior of the tubular housing 30, and when so positioned can move radially to a limited extent within the windows but cannot move radially outwardly through the windows to disengage themselves from the housing. The shoulders 34 and corresponding projections 35 extend the full length of the scraper blocks 32 and project somewhat beyond the longitudinal edges 36 of the windows 31.

The scraper blocks are retained in position by respective base plates 37 which are secured to the body 30 by screws 38. The heads of the screws faced radially inwardly, i.e. the screws are inserted form the interior of the body 30. Accordingly, each blade module can be pre-assembled as a complete unit before being mounted on the mandrel 2. A small working clearance is provided between the head of each screw 38 and the mandrel 2 with the result that the degree to which each screw 38 can back off in use is limited by the presence of the mandrel itself. After assembly the screw 38 will, in general, be locked in place by suitable means, for example a thread locking compound. However, the arrangement described ensures integrity of the assembly in use even if the primary screw locking arrangements fail. The screws 38 preferably have a socket formation on the radially outer end thereof as well as on the radially inner end. The formation on the outer end will be accessible via the through holes provided for the screws in the tubular body and accordingly the screws may be tightened either during assembly or on site by means of a tool inserted radially inwardly through the screw holes.

Springs 39 are provided to act between each base plate 37 and its associated scraper block 32 so that the scraper blocks are biassed radially outwardly relative to the longitudinal axis of the tool. The maximum external diameter of the scraper blades is determined by the inter-engagement of the shoulders 34 and the projections 35. However, if a tool is run in a casing having a diameter less than this maximum, this reduced diameter can be accommodated by compression of the springs 39. For example, in a typical design intended for a nominal 9⅝ casing the overall diameter defined by the blades may vary from 8.469 inch to 9.175 inch. The spring load may be adjusted either by adjusting the strength of the springs or the number of the springs. In the preferred embodiment of the invention a total of eleven spring positions are provided under each block. Some or all of these locations may be furnished with springs according to the spring strength required.

Preferably, the springs 39 are high strength die springs.

As illustrated, each of the stabilizers has right hand helical blades. It will be appreciated, however, that other blade configurations are possible and in particular in certain applications straight blades may be desirable.

The castellation arrangements for rotationally interlocking the components allow the respective blade modules to be circumferentially offset from each other as illustrated in FIG. 1 to enable the entire casing ID to be scraped without rotating the assembly 20. Further, it will be noted that the block modules 5, 6 and 7 may be inverted relative to the position illustrated in FIG. 1, and the device will still operate. Accordingly, either the block modules may be inverted to bring fresh scraping faces into service or the entire tool may be inverted and connected into the string by suitable cross overs in order the extend the service life of the tool before stripping down and replacement of the scraper blocks is required.

It will be noted that each of the blade modules 5,6,7 is located radially by the components at either end thereof. To this end, each of the adjacent components includes a spigot portion which extends into the end region of each housing to provide radial support for the housing. The effect of this arrangement is that the blade modules are located radially relative to the mandrel by the components on either side of the module. Accordingly, a small running clearance can be provided between the components of the modules and the underlying mandrel so that the modules do not rub on the mandrel when the tool is operating in its non-rotating mode. It will also be noted that although in the preferred arrangement the stabilisers are mounted by means of ballbearings and axial load imposed by the thread protector 10 is reacted on the mandrel via the ballbearings, alternative arrangements are possible and in particular a plane thrust bearing may be provided for reacting the axial loading imposed by the thread protector.

It will be noted from FIG. 4 in particular that each end of each scraper block is furnished with a chamfered ridge 40 to guide the blades into the casing and to ensure that the square scraping faces do not get caught on the entry guide. The angle of the scraper edges is to the left, i.e. opposite to the right-hand angle of the stabilisers, to maximise the angle of attack of the scraper blocks on the casing especially if the tool is run in a rotating mode. In general, the external surfaces of the scraper blocks will be hardened, for example by case-hardening, but will not normally be hard faced so as to reduce the chances of scoring or wearing the casing wall.

The stabilisers will be machined so that the tool outside diameter corresponds to the inside diameter of the casing drift so that the scraper blocks will be able to travel to scrape the casing at any angle from vertical to horizontal. Typically, on a design for a 9⅝ casing each block will have a radial travel of at least 5/16 ths inch giving a total diameter variation of at least ⅝ inch.

The invention claimed is:

1. A casing scraper comprising: a mandrel; at least one blade module mounted on the mandrel for rotation relative to the mandrel so that, in use, the scraper can be operated with the mandrel rotating relative to the casing being scraped and the blade module non-rotating relative to the casing being scraped, the or each blade module comprising a tubular housing having a plurality of through windows formed therein; a respective scraper block mounted in each window, each scraper block having retaining projections extending beyond a periphery of the associated window, the retaining projections preventing the scraper block from moving completely outwardly through its associated window; spring means acting on the scraper blocks to bias them radially outwardly of the housing; and reaction members attached to an inner radial surface of the tubular housing so as to overlay the associated window, the reaction members engaging the spring means and the housing to react the spring force applied to the scraper blocks onto the housing in which the respective scraper block is mounted, the spring means engage between the reaction member and its associated scraper block.

2. A casing scraper according to claim 1 comprising a plurality of said modules provided along the length of the tool.

3. A casing scraper according to claim 2 wherein the respective modules are identical and are interconnected to prevent relative rotation therebetween.

4. A casing scraper according to claim 3 wherein adjacent modules are rotationally offset from each other, so that the blades of adjacent blade modules scrape different circumferential zones of the casing.

5. A casing scraper according to claim 3 wherein the interconnecting means comprise castellations formed on the modules.

6. A casing scraper according to claim 2 wherein the respective modules are interconnected by interconnecting means which comprise castellations formed on the modules.

7. A casing scraper according to claim 6 wherein the interconnecting means comprises a coupler having castellations complementary to the castellations of the modules.

8. A casing scraper according to claim 7 including means for rotationally locking the or each module to the associated mandrel so that the tool may function as a rotating scraper.

9. A casing scraper according to claim 8 wherein a locking member is provided on the scraper, the change from non-rotating to rotating operation being effected by manipulation of the locking member.

10. A casing scraper according to claim 7 including stabilisers at both ends of the blade modules, the stabilisers being rotatably mounted on the mandrel.

11. A casing scraper according to claim 10, wherein the stabilisers are each located on the mandrel by ball-bearings positioned between the stabilisers and the mandrel.

12. A casing scraper according to claim 10, wherein the stabilisers are locked against rotation relative to the mandrel by a locking member when the locking member is manipulated to lock the or each blade module relative to the mandrel.

13. A casing scraper according to claim 12, wherein the locking member is a thread protector screw-threadedly mounted on the mandrel and rotatable relative to the mandrel from a first position spaced from the stabilisers to a second position in engagement with one of the stabilisers to apply an axial load to the stabiliser which is reacted on the mandrel by ball-bearings.

14. A casing scraper according to claim 10, wherein each blade module is supported radially on support components located at each end thereof and a running clearance is provided between the modules and mandrel.

15. A casing scraper according to claim 1 wherein the spring means are coil springs.

16. A casing scraper according to claim 1 wherein the reaction members are base plates which are secured to the housing.

17. A casing scraper according to claim 16 wherein each base plate is secured to the housing by screws which are inserted from the interior of the tubular housing with the heads of the screws located facing radially inwardly.

18. A casing scraper according to claim 17 wherein backing off of the screws to an extent which will disengage the screws from the housing is prevented by the presence of the mandrel.

19. A casing scraper according to claim 1 wherein each blade module is symmetrical so that it will fit either way up in its associated window.

20. A casing scraper according to claim 1, wherein the scraper blocks have chamfered ridges at the ends thereof to guide the scraper blocks into the casing.

* * * * *